United States Patent [19]

Jackson

[11] 4,337,590

[45] Jul. 6, 1982

[54] REFLECTIVE DEVICE FOR CARRYING VARIABLE INFORMATION FOR EXAMPLE FOR ADVERTISING PURPOSES

[76] Inventor: Harold Jackson, Flat 5, 123 Gloucester Pl., London W. 1, England

[21] Appl. No.: 188,593

[22] Filed: Sep. 18, 1980

[51] Int. Cl.[3] ..... G09F 19/00

[52] U.S. Cl. ..... 40/615; 40/10 R; 40/219

[58] Field of Search ..... 40/152.2, 615, 152, 40/584, 615, 219; 272/8 M

[56] References Cited

U.S. PATENT DOCUMENTS

| | | | |
|---|---|---|---|
| 1,696,489 | 12/1928 | Kahn | 40/615 |
| 2,499,452 | 3/1950 | Bonnet | 40/152.2 X |
| 2,500,511 | 3/1950 | Bonnet | 40/152.2 X |
| 2,522,812 | 9/1950 | Bonnet | 40/152.2 X |

FOREIGN PATENT DOCUMENTS

| | | | |
|---|---|---|---|
| 760619 | 2/1934 | France | 40/615 |
| 1575609 | 9/1980 | United Kingdom | 40/615 |

*Primary Examiner*—Gene Mancene
*Assistant Examiner*—Wenceslao J. Contreras
*Attorney, Agent, or Firm*—Fay & Sharpe

[57] ABSTRACT

A reflecting device for the display of information includes a substantially flat layer of highly reflecting material placed over a backing member. Over the reflecting material is laid a single sheet of transparent or translucent synthetic plastics material having the information printed thereon. The flat layer, the backing member, and the sheet are all held together by a frame carrying a pane of plain glass or equivalent which frame can be opened for removal and replacement of the sheet.

13 Claims, 2 Drawing Figures

Figure 1:
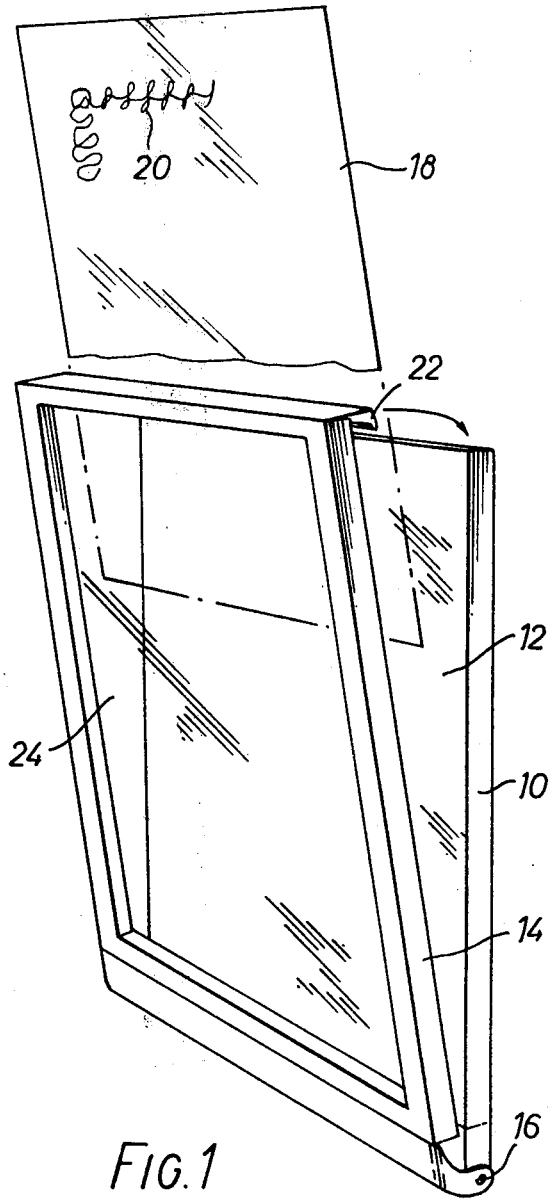

REFLECTIVE DEVICE FOR CARRYING VARIABLE INFORMATION FOR EXAMPLE FOR ADVERTISING PURPOSES

This invention relates to a reflecting device for display of information, and particularly although not exclusively to a reflecting device useful for advertising purposes.

According to the invention in its broadest aspect, there is provided a reflecting device for the display of information which includes a substantially flat layer of highly reflecting material placed over a backing member and over which is laid a single sheet of transparent or translucent synthetic plastics material having the information printed thereon, the flat layer, the backing member, and the sheet all being held together by a frame carrying a pane of plain glass which can be opened or removed to facilitate removal and replacement of the sheet.

Desirably the frame may be hinged to the backing member or to a support for the backing member. The glass in the frame serves for holding the sheet in its proper position. Of course by opening the frame the sheet may be changed and replaced by another similar sheet bearing different information, for example a different advertising message.

The reflecting material may be supported upon a resilient backing constructed to ensure so far as possible that the reflecting surface of the reflecting material is kept perfectly flat when the frame carrying the pane of glass is closed.

The reflecting device may be incorporated in a display cabinet or display frame, and such a cabinet or frame could be installed in supermarkets, retail outlets, or other public places. Since the highly reflective surface serves as a conventional mirror, it is to be expected that the public will give more attention to the device than is the case with a conventional advertising poster or showcard. An important feature of the invention is that one obtains the extra viewer-interest accruing to a mirror without the inflexibility of having an advertising message printed on the mirror glass. It has long been known to use conventional silvered glass mirrors to carry an advertising message which may be placed thereon by silk-screen printing or other means, but to change the content of the message on such mirrors, without installing an entirely new mirror, is extremely difficult, if not impossible. This severely limits the utility of such devices. By the use of the present invention, the advertising or information legend can be changed as often as desired with little expense compared to prior reflecting devices which have been proposed for use in advertising.

In a preferred version of the invention the sheet is a cellulose acetate sheet printed on its rear surface, that is, on the surface which in use is in contact with the reflective material. The latter is preferably a commercially available highly-reflective film.

The legend on the sheet may be applied thereto by any convenient means: for example by lithography or by silk screen printing. Materials other than cellulose acetate sheet may be used, provided that they are transparent, and can receive the desired legend.

The reflective material may be an acrylic plastics sheet upon which a highly-reflective layer of aluminium has been vapour deposited.

Figure 2:
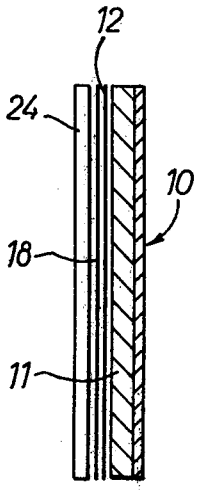

The invention will be better understood from the following description of an illustrative and non-limiting embodiment, given with reference to the drawings accompanying the Provisional Specification, in which:

FIG. 1 is a perspective view of a framed reflective device according to one example of the invention, and FIG. 2 is a vertical cross section on a smaller scale through the device of FIG. 1.

Referring firstly to FIG. 1, the reflective device illustrated includes a backing member or support in the form of a plate 10, e.g. of metal, of rectangular shape which can be secured by any convenient means to a wall, door, window or other suitable support. Over its front surface is positioned a highly-reflective synthetic plastics material 12. This is secured by a suitable securing means or frame around the four edges of the backing member 10. An openable frame 14 has a front window formed by plain flat glass or equivalent material and is hinged about a horizontal pivot 16 so that it can be opened and closed to allow insertion and removal of a sheet of transparent synthetic plastics material 18 which carries the desired information or legend 20. As shown, the frame 14 is hinged relative to the backing plate 10 about a horizontal axis, and it is held in its closed position by a clip at the top edge and generally indicated at 22. However, it will be understood that the frame could be hinged about a vertical axis and other securing means could be employed. In some case, a lockable cabinet type of construction may be appropriate.

The sheet of transparent synthetic plastics material 18 has the legend printed on its rearside, for preference, and is desirably of thin gauge. While in this specification it has been referred to as transparent, it will be realised that a translucent sheet which transmits enough light for the viewer to see his reflection reasonably clearly may also be suitable in certain applications of the invention. The sheet 18 is a thin sheet, by which is meant that its thickness is in general not greater than that of a sheet of thick writing paper.

As an alternative to having the film 12 tightly stretched over the backing plate 10, the plate 10 then being rigid or having four rigid margins, the backing plate may carry a resilient pressure pad as shown in FIG. 2. In FIG. 2 there is illustrated a device which has a backing board 10 which carries a rectangular pressure pad 11. Over this is stretched the highly-reflective synthetic plastics film 12, and the frame 14, not shown in FIG. 2, has a front "window" formed by a pane of plain glass 24. Between the glass 24 and the film 12 is disposed the replaceable thin sheet of synthetic plastics material carrying the desired information or legend. This is denoted by 18 in both the Figures. The information or legend may be placed on the sheet 18 by "micro-dot" printing, or by a silk screen process, or by any other suitable means.

If it is desired to produce a "distorting-mirror" effect, for example when using humorous advertising messages, the backing member 10 may be curved or undulating. Usually, however, it will be flat.

In use, it will be realised that the device as a whole has the appearance of a mirror to the onlooker, but that the advertising message or other legend is carried in a position where it will inevitably be seen and noticed by an onlooker. Also, since it is presented in close juxtaposition to the image of the onlooker, it is to be expected that a favourable mental impression in the mind of the onlooker will be created. In order to change the "message" or legend, it is merely necessary to open the frame 14, take out one sheet 18, and replace it by a similar sheet bearing a different legend. In consequence, it will be realised that the information presented can very readily and cheaply be changed, but in all cases, the message concerned appears to the onlooker in close association with his or her own reflection.

What I claim is:

1. A reflecting device for the display of information which includes a substantially flat layer of highly reflecting material placed over a backing member and over which is laid a single flexible sheet of transparent or translucent synthetic plastics material having the information printed thereon, the flat layer, the backing member, and the sheet all being held together by a frame carrying a pane of substantially rigid transparent material having parallel, flat front and rear surfaces, said frame being constructed in such a manner that it can readily be opened for removal and replacement of the sheet, whereby a person's mirror image is viewable in the flat layer through the pane and sheet while simultaneously viewing the information printed on the sheet.

2. A reflecting device according to claim 1 in which the flat layer is formed by a film of highly-reflective synthetic plastics material, and the sheet is transparent and is smoothly laid over the film.

3. A device according to claim 2 in which the sheet is placed over the highly reflecting material and is secured around its edges by the frame.

4. A device according to claim 1, in which the information is silk screen printed onto the sheet.

5. A device according to claim 1, in which the sheet is of cellulose acetate.

6. A device according to claim 1 in which the sheet is printed on its surface which contacts the reflective material.

7. A device according to claim 1 in which the pane comprises plain glass.

8. A device according to claim 1 in which the frame is hinged to the backing member so that it can be opened to allow insertion of the sheet and closed to hold the sheet against the backing member.

9. A device according to claim 1 in which the visible portion of the sheet and the flat layer are both rectangular.

10. A device according to claim 1 in which the reflective material is an acrylic plastics sheet upon which a highly-reflective layer of aluminium has been deposited.

11. A device according to claim 8 in which the backing member is resilient.

12. A reflecting device for the display of information comprising a substantially flat layer of highly reflecting material placed over a rectangular backing member and over which is laid a single sheet of plastic material through which a person's mirror image is viewable in said flat layer, said sheet bearing an advertising legend thereon, the sheet, the flat layer, and the backing member being held together in that order by a frame carrying a pane of flat substantially rigid transparent material which frame is supported by means whereby it can be opened and closed to respectively move the pane away from or toward the flat layer for removal and replacement of the sheet, whereby a person's mirror image is viewable in the flat layer through the sheet and pane while simultaneously viewing the legend on the sheet.

13. A device according to claim 12 in which said sheet comprises cellulose acetate.

* * * * *